US009822485B2

(12) United States Patent
Wiertz et al.

(10) Patent No.: US 9,822,485 B2
(45) Date of Patent: Nov. 21, 2017

(54) COMPACT FORMER SECTION

(71) Applicant: GapCon GmbH, Munich (DE)

(72) Inventors: Wolfgang Wiertz, Krefeld (DE); Francesco Di Biasi, Verona (IT); Wolfgang Mark, Meerbusch (DE)

(73) Assignee: GAPCON S.R.L., Verona (IT)

( * ) Notice: Subject to any disclaimer, the term of this patent is extended or adjusted under 35 U.S.C. 154(b) by 4 days.

(21) Appl. No.: 14/712,859

(22) Filed: May 14, 2015

(65) Prior Publication Data

US 2015/0330021 A1 Nov. 19, 2015

(30) Foreign Application Priority Data

May 15, 2014 (EP) ..... 14168415

(51) Int. Cl.

| | |
|---|---|
| ***D21F 3/08*** | (2006.01) |
| ***D21F 9/00*** | (2006.01) |
| ***D21F 1/48*** | (2006.01) |
| ***D21F 3/02*** | (2006.01) |
| ***D21F 3/04*** | (2006.01) |
| ***D21F 11/14*** | (2006.01) |

(52) U.S. Cl.

CPC ..... *D21F 3/08* (2013.01); *D21F 1/48* (2013.01); *D21F 3/0209* (2013.01); *D21F 3/0272* (2013.01); *D21F 3/045* (2013.01); *D21F 9/003* (2013.01); *D21F 11/14* (2013.01)

(58) Field of Classification Search

CPC ..... D21F 3/045; D21F 9/003; D21F 3/0272; D21F 1/0027; D21F 3/0209; D21F 3/08; D21F 1/48; D21F 7/08; Y10S 162/90

See application file for complete search history.

(56) References Cited

U.S. PATENT DOCUMENTS

| | | | | |
|---|---|---|---|---|
| 3,470,063 A | | 9/1969 | Sanford | |
| 3,775,243 A | * | 11/1973 | McCarrick | D21F 3/0272 100/121 |
| 4,113,556 A | * | 9/1978 | Kankaanpaa | D21F 9/003 162/272 |
| 4,894,120 A | * | 1/1990 | North | D21F 9/003 162/203 |

(Continued)

FOREIGN PATENT DOCUMENTS

| | | | | |
|---|---|---|---|---|
| DE | 2725351 A1 | | 12/1978 | |
| DE | EP 0863254 A2 | * | 9/1998 | D21F 11/04 |

(Continued)

*Primary Examiner* — Jose Fortuna

(74) *Attorney, Agent, or Firm* — Douglas Denninger

(57) ABSTRACT

A former section including a headbox, a felt, a wire, a forming roll having a suction zone and a forming section, and a gap section defined by the section between the headbox and a position where the felt and the wire are brought together at the forming roll. The headbox distributes a pulp slurry into the gap section to be sandwiched by the felt and the wire to form a paper sheet. A bottom side of the paper sheet contacts the felt and a top side of the paper sheet contacts the wire, and the sandwiched felt, paper sheet and wire wrap around the forming roll. A press roll forms a nip with the forming roll through which the paper sheet is carried by the felt and the wire, and the suction zone of the forming roll is arranged in a section around the nip.

17 Claims, 2 Drawing Sheets

(56) References Cited

U.S. PATENT DOCUMENTS 4,923,568 A * 5/1990 Hietikko ..... D21F 9/003 162/301
6,248,210 B1 * 6/2001 Edwards ..... D21F 3/0218 162/109
6,558,511 B2 * 5/2003 Dwiggins ..... B31F 1/07 162/112
7,491,160 B2 * 2/2009 Vestola ..... D21F 3/105 492/28
7,691,228 B2 * 4/2010 Edwards ..... D21F 3/0218 162/111
2002/0060046 A1 * 5/2002 Scherb ..... D21F 3/0281 162/358.1
2002/0066544 A1 * 6/2002 Dwiggins ..... D21F 11/002 162/158
2002/0148584 A1 * 10/2002 Edwards ..... D21F 3/0218 162/204
2003/0070781 A1 * 4/2003 Hermans ..... D21F 1/48 162/115
2003/0226650 A1 * 12/2003 Edwards ..... D21F 3/0218 162/289
2004/0226673 A1 * 11/2004 Edwards ..... D21F 3/0218 162/109
2004/0238135 A1 12/2004 Edwards
2005/0098282 A1 * 5/2005 Scherb ..... B65H 18/26 162/123
2005/0150626 A1 * 7/2005 Kanitz ..... D21F 3/0272 162/303
2005/0166418 A1 * 8/2005 Lomic ..... D21F 5/004 34/117
2005/0176566 A1 8/2005 Vestola
2005/0217814 A1 * 10/2005 Super ..... B31F 1/126 162/111
2006/0144545 A1 * 7/2006 Gustavsson ..... D21F 3/0218 162/205
2008/0035289 A1 * 2/2008 Edwards ..... D21F 3/0218 162/111
2010/0059192 A1 * 3/2010 Scherb ..... B65H 18/26 162/263
2010/0065234 A1 * 3/2010 Klerelid ..... D21F 11/006 162/111
2011/0088859 A1 * 4/2011 Hultcrantz ..... D21F 1/0027 162/111
2012/0103544 A1 * 5/2012 Scherb ..... D21F 1/02 162/113
2015/0152603 A1 * 6/2015 Super ..... B31F 1/126 162/111
2015/0330021 A1 * 11/2015 Wiertz ..... D21F 3/08 162/202
2016/0160443 A1 * 6/2016 Duhen ..... D21H 7/002 428/514

FOREIGN PATENT DOCUMENTS

DE EP 1544350 A1 * 6/2005 ..... D21F 1/32
DE EP 2796617 A1 * 10/2014 ..... D21F 11/14
EP 0404189 A1 * 12/1990 ..... D21F 9/006
EP 14168415.9 7/2014
FI EP 1564327 A1 * 8/2005 ..... D21F 3/105
FI DE 102008000055 A1 * 7/2008 ..... D21F 3/04
IT EP 2944720 A1 * 11/2015 ..... D21F 3/08
WO WO-96-17126 A1 6/1996
WO WO-2009-063396 A1 5/2009

* cited by examiner

COMPACT FORMER SECTION

CROSS-REFERENCE TO RELATED APPLICATION

This application claims priority to European Patent Application No. EP14168415.9 filed 15 May 2014. The entire contents of each of the above-mentioned applications are incorporated herein by reference.

FIELD OF THE INVENTION

This invention relates to paper machines, specifically tissue paper machines, and manufacturing methods for producing tissue paper.

BACKGROUND OF THE INVENTION

Methods, systems and apparatus for manufacturing paper are known in the state of the art. In a conventional system for making tissue paper, for example, the system typically includes three sections: a forming section, a pressing section and a drying section. In the forming section, paper pulp is provided continuously from a headbox to a felt. A forming roll thereafter removes much of the water content of the paper pulp as it is transported through the forming section via the felt. The initially made paper web is carried to a press section, whereby the water content of the paper pulp is further reduced to a desired level before it is transferred to a drying section. The paper web is loaded onto a dryer of the drying section to be dried, and thereafter creped to form the tissue paper.

While widely adopted and accepted in the industry, this conventional system has a few drawbacks and has room for improvement. A primary concern with regard to the conventional system comprising these three sections is the large amount of space required to accommodate the conventional system. Each section includes large rolls and/or presses. Moreover, due to their large sizes, they have to be spaced sufficiently apart from each other to avoid interference and provide ease of accessibility for maintenance. As a result of the separation, in turn this requires the felts to transport the paper pulp over certain distances from one section to the next section. During the course of this transport the paper pulp is freely positioned on the felt and must be kept adequately on the felt. A potential risk is that errors may happen during this transport. For example, parts of the paper pulp may become separated or loosened despite the measures in place or the paper pulp may become shifted on felt during the course of travel.

One conventional solution provides suction boxes along the transport path of the felt between neighbouring sections. Other solutions involve changing the angle of the pathway, usage of additional components, and different materials of the felt to aid the attachment of the paper pulp on the felt. However, with all these solutions more components and energy are required which increases the operation cost of these systems.

Therefore, there is a need in the field to provide a system that can ideally minimize the space required to accommodate the paper making system, can reduce energy and costs and can also alleviate some of the concerns while transporting the paper pulp.

SUMMARY OF THE INVENTION

An object of the present invention is to solve or at least reduce some of the above-identified problems in the paper manufacturing systems.

This invention features a former section including a headbox, a felt, a wire, a forming roll having a suction zone, a save-all for collecting water, especially white water, from a forming section in the area of the forming roll, and a gap section defined by the section between the headbox and a position where the felt and the wire are brought together at the forming roll. The headbox distributes a pulp slurry into the gap section to be sandwiched by the felt and the wire to form a paper sheet. A bottom side of the paper sheet contacts the felt and a top side of the paper sheet contacts the wire, and the sandwiched felt, paper sheet and wire wrap around the forming roll. A press roll forms a nip with the forming roll through which the paper sheet is carried by the felt and the wire, and the suction zone of the forming roll is arranged in a section around the nip.

In some embodiments, the suction zone of the former includes a section positioned at least one of before the nip, at the nip and after the nip. In certain embodiments, the former includes a forming roll which comprises at least one forming zone which is a part of the forming roll surface having an angle between 10° and 180°, preferably between 30° and 120°, and more preferably between 30° and 75° with respect to a jet impingement onto the forming roll. In one embodiment, the suction zone does not cover or overlap the forming zone.

In a number of embodiments, the suction zone does at least overlap the forming zone area in one section, especially in a range between 5° to 90°, preferably between 10° and 75°, and especially between 15° and 25°. In some embodiments, the suction zone is formed with an arc between 5° and 180°, preferably between 5° and 75° and especially between 15° and 45°, with respect to a jet impingement onto the forming roll. In some embodiments, the press roll has at least one of a soft cover, a hard cover, a belt and especially is a shoe roll or extended nip roll. In one embodiment, the press roll provides at least one substantially uniform pressure plateau across the width of the nip. In some embodiments, the nip has a force between 10 to 200 N/mm, preferably between 60 to 120 N/mm and especially between 90 to 110 N/mm.

In certain embodiments, the solid content of the paper sheet before the press nip at the forming roll is between 4% to 15%, preferably between 4% to 14% and especially between 9% to 12% and/or the solid content of the paper sheet after the press nip at the forming roll is between 9% to 48%, preferably between 30% to 48% and especially between 40% to 46%. In some embodiments, the forming roll has perforations and grooves along the surface. The former section further includes at least a second save-all at the end of the suction zone in one embodiment. The press roll is a guide roll in one embodiment and, in another embodiment, the former section further comprises an adjustable guide roll positioned downstream of the press roll. In one embodiment, the former section further includes a yankee cylinder and a second press roll which form a nip with the yankee cylinder, and the paper sheet is transferred to the yankee cylinder by the felt carrying the paper sheet through the nip. In some embodiments, the former section is a crescent former for producing tissue paper grades. In a number of embodiments, the former section is included in a machine that manufactures at least one of paper, board and tissue paper.

The present invention is also directed to a method for producing paper, especially tissue paper, in a former including a headbox, a felt, a wire, a forming roll having a suction zone, a save-all for collecting water, especially white water, from a forming section in the area of the forming roll and a gap section defined by the section between the headbox and a position where the felt and the wire are brought together at the forming roll. The method includes steps of distributing a pulp slurry by the headbox into the gap section to be sandwiched by the felt and the wire to form a paper sheet, wherein a bottom side of the paper sheet contacts the felt and a top side of the paper sheet contacts the wire, and the sandwiched felt, paper sheet and wire wrapping around the forming roll. The unique method is characterized in that this method further comprises carrying the paper sheet by the felt and the wire through a nip formed by the forming roll and a press roll of the former, wherein the suction zone of the forming roll is arranged in a section around the nip.

BRIEF DESCRIPTION OF THE DRAWINGS

In what follows, preferred embodiments of the invention are explained in more detail with reference to the drawings, in which.

DETAILED DESCRIPTION OF THE PRESENTLY PREFERRED EMBODIMENTS

Figure 1:
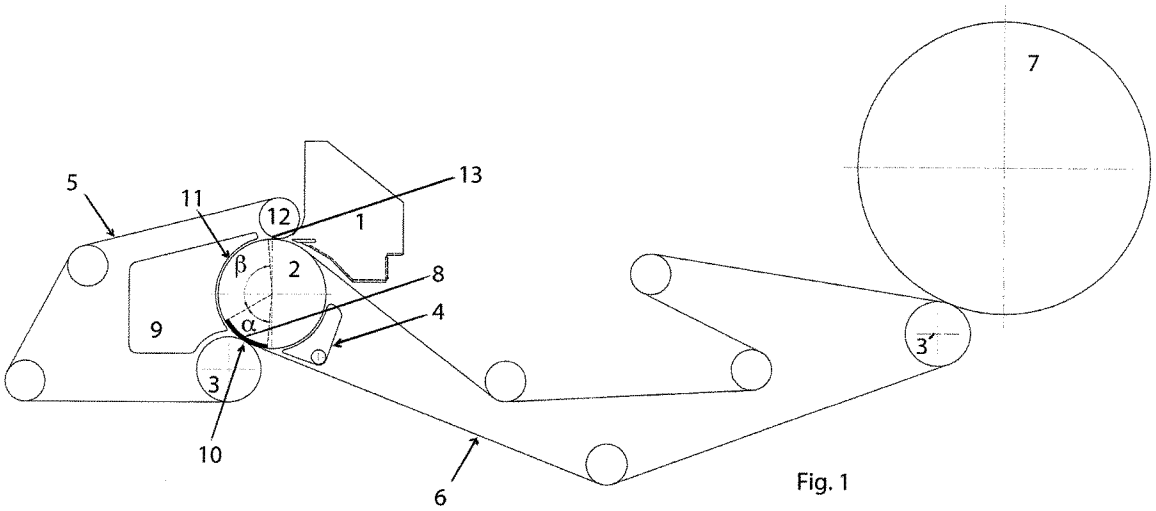
FIG. 1 is a schematic diagram of the system according to a first configuration of the present invention.

This invention may be accomplished by a system having a former section, and a method of using the former section, including a headbox, a felt, a wire, a forming roll having a suction zone, a save-all for collecting water, especially white water, from a forming section in the area of the forming roll, and a gap section defined by the section between the headbox and a position where the felt and the wire are brought together at the forming roll. The headbox distributes a pulp slurry into the gap section to be sandwiched by the felt and the wire to form a paper sheet. A bottom side of the paper sheet contacts the felt and a top side of the paper sheet contacts the wire, and the sandwiched felt, paper sheet and wire wrap around the forming roll. A press roll, positioned as a counter-roll, forms a nip with the forming roll through which the paper sheet is carried by the felt and the wire, and the suction zone of the forming roll is arranged in a section around the nip.

Advantageously, by using the counter-roll opposite the forming roll as a press roll, the press section is combined with the forming section reducing the required space for the system. A separate press section is no longer necessary as its function is performed directly at the end of the forming section where a press nip is formed.

Furthermore, the number of components is reduced as the pressing section is eliminated and the components therein, as well as those arranged in the pathway, such as suction boxes alongside the forming section to the pressing section, are also no longer required. This saves space, components and energy previously required to form, maintain and operate this section.

The pathway of the paper sheet between the forming section and the drying section is also shortened. The paper sheet is no longer transported from the forming section to the pressing section, and then from the pressing section to the drying section, but directly from the forming section to the drying section. It can be assumed that this reduces the chance of an error occurring during transportation, e.g. paper sheet detaching from the felt or shifting of the paper sheet on the felt.

In the present invention, the felt is the transport means for carrying the paper sheeting throughout the system. The felt, which typically is continuous, is distinct from a wire of known paper machines in that the felt is made of a material that is water permeable and has water absorption properties. In a wetted state, the felt can hold the paper sheet based on the adhesion due to the water content of the paper sheet and felt. Another important aspect of the present invention is to use a felt, rather than a wire, to carry the paper sheet since it allows water contained in the paper sheet to travel through the felt in the nip section.

A wire is a woven, typically continuous belt of fine mesh screen and is used in the present invention to provide the sandwiched arrangement formed by wire, paper sheet and felt. Usually it is made of synthetic polymer—for instance polymer monofilament—and is called a forming fabric.

In some constructions, the suction zone of the former includes a section at least one of before the nip, at the nip and after the nip. For the purpose of the present invention a suction zone is understood as the area (or areas) in which a vacuum is created, typically by one or more suction elements. The function of the suction zones serves a number of useful purposes. It aids to keep the paper sheet on the felt, since the felt is the closest to the suction zone and the felt should carry the paper sheet by attracting the paper sheet more tightly to the side of the suction zone. Furthermore, the suction zone while keeping the paper sheet tighter to the felt also keeps the sheet flat to the felt, reducing any irregularities along the surface of the sheet. This is the primary reason for setting suction zones before and after the press nip to keep the sheet as uniform and flat as possible. Any irregularity when fed through the press nip would ruin the integrity of the paper sheet. The suction zone typically maintains a vacuum/negative pressure of around 40 to 60 kPa, but this value may vary depending on the need of the paper machine.

Due to the introduction of the press nip at the forming section provision of means for collecting water, which is pressed out of the paper sheet by the nip is a further crucial point. Otherwise, the water would not be removed and retained within the vicinity of the paper sheet. This risks the water being reintroduced to the paper sheet and the felt, which may disrupt the desired water content of the paper sheet and the felt. This in turn affects the aforementioned adhesion property of the felt and at the same time the solid water content desired for the paper sheet itself. Therefore, suction zones provided at the press nip maintain proper function of the forming section and production of the desired paper sheet.

In one embodiment, the former includes a forming roll which comprises a forming zone area which is a part of the forming roll surface having an angle between 10° and 180°, preferably between 30° and 120°, and more preferably between 30° and 75° with respect to a jet impingement onto the forming roll. Jet impingement with respect to the present invention is understood as the jet impact point/area onto the wedge formed by the wire and felt along its main stream direction.

The forming section can range from half of the forming roll starting at the jet impingement position to as small as $1/8^{th}$ of the forming roll. A larger forming section will allow a more gradual and smooth dewatering process while a smaller section presents a more concentrated one. Generally smaller forming sections are used for lighter paper grades.

The radius of the forming roll inherently affects the dewatering process as well. A smaller roll will rotate more quickly with the same power input than a bigger roll, and consequently dewater more water in a forming section of the same angle.

Furthermore, the suction zone may not cover or overlap the forming zone area. Arrangement of the suction zone away from the forming zone avoids interference of these components. The forming zone operates by collecting water in a save-all located opposed to the forming roll. It collects water of the paper sheet that is removed by the rotational force of the forming roll. This dewatering process by the rotation of the forming roll fixes the fibres of the pulp in place forming the paper sheet. The suction zone is aimed to act on the resulting paper sheet, by keeping it smooth and in place. Therefore, it is preferred to arrange the suction zone following the forming zone.

According to another embodiment of the invention, the suction zone is formed with an arc between 5° and 180°, preferably between 5° and 75°, more preferably between 20° to 30°, and especially 25°, the angles between 105° and 130° starting at the jet impingement onto the forming roll.

In another embodiment, the press roll has a soft or hard cover or belt and especially is a shoe roll or extended nip roll. The press roll may also comprise a flexible press structure providing a substantially uniform pressure across the width of the nip. A uniform press nip provides a smooth press and leads to consistent paper sheet throughout the pressed section.

In conjunction with an extended nip press roll and particularly with a press structure or roll providing a substantially uniform pressure across the width of the nip a soft belt is used. The use of the soft belt allows for example to achieve the higher loading range for a tissue production (10-200 N/mm and particularly 60-120 N/mm) without the risk of damaging the forming wire. According to this arrangement a soft belt provides a good performance with respect to sheet dryness after the nip (because of the relatively high nip load) and in terms of the specific paper volume (because of the relatively nip width).

A conventional press roll cover may have a hardness between 25 to 55 P & J (Pusey and Jones—Plastometer Hardness Scale), but most typically in the range of 35 to 46 P & J. The nip load of a conventional press roll might be limited due to the wire guided through the nip and therefore the nip load range might be 5-60 N/mm, but more typically only 15-25 N/mm. Even if the application of a conventional press roll is easier to install, a conventional press roll has at least load limitations because the wire has performance limits, especially in terms of dryness.

The former of the present invention may also have a nip, which has a force between 10 to 200 N/mm, preferably between 60 to 120 N/mm. This range is optimal for producing tissue paper and provides a press that does not over press or damage (e.g., create press marks) on the paper sheet.

In the system of the present invention, the solid content of the paper sheet before the press nip at the forming roll is preferably between 9% to 12% and the solid content of the paper sheet after the press nip at the forming roll is preferably between 40% to 46%. Such solid contents are not achievable with conventional forming sections and allow the dewatering to occur at a much earlier stage of the paper manufacturing process.

In order to allow water to be removed from the paper sheet in the suction zones, the forming roll may have perforations and grooves along the surface. The water travels through the felt carrying the paper sheet to the surface of the forming roll. If no perforations or grooves are provided, the water would simply be held in the felt. This can disrupt the desired adhesion level of the felt necessary to hold the paper sheet on its surface. Thus, it is helpful to provide perforations or grooves which act as an outlet for the unwanted water on the forming roll.

The former of the present invention may further comprise another save-all at the end of the suction zone or press zone. Similar to the save-all provided preceding the suction zone(s), a secondary save-all can serve to collect white water removed from the paper sheet by the rotational force of the forming roll that comes from the surface of the forming roll following the press nip. The second save-all helps to provide increased drainage of white water in the forming section.

In another embodiment of the present invention, the press roll is a guide roll or the former further comprises a guide roll for the wire positioned downstream of the press roll. The press roll serving also as a guide roll would act as a guide roll as in conventional forming sections. Alternatively, an additional guide roll can be set up to change the angle of the wire leaving the sandwiched wire, paper sheet and felt. This additional component affects the quality of the paper sheet, which will thereafter be brought to the drying section. A more gradual separation of the wire may provide a smoother top surface and facilitate proper edge quality.

The former of the present invention may also comprise a Yankee cylinder and a second press roll which form a nip wherein the paper sheet is transferred to the Yankee cylinder by the felt carrying the paper sheet through the nip. The Yankee cylinder and second press roll represent a conventional drying section, where the paper sheet is finally dried to its desired final state.

The former section of the present invention is preferably a crescent former for producing tissue paper grades, having a grammage between 15 to 40 g/m$^2$. Moreover, the above described former sections have applications and are quite suitable in paper, board or tissue paper machines.

The present invention is also directed to a method for producing paper, especially tissue paper, in a former including a headbox, a felt, a wire, a forming roll having a suction zone, a save-all for collecting water, especially white water, from a forming section in the area of the forming roll and a gap section defined by the section between the headbox and a position where the felt and the wire are brought together at the forming roll. The method includes steps of distributing a pulp slurry by the headbox into the gap section to be sandwiched by the felt and the wire to form a paper sheet, wherein a bottom side of the paper sheet contacts the felt and a top side of the paper sheet contacts the wire, and the sandwiched felt, paper sheet and wire wrapping around the forming roll. The unique method is characterized in that this method further comprises carrying the paper sheet by the felt and the wire through a nip formed by the forming roll and a press roll of the former, wherein the suction zone of the forming roll is arranged in a section around the nip. The method of the present invention is advantageous for the same reasons as the corresponding system as discussed above.

The present invention will be described more detailed in the following with reference to the drawings, in which preferred embodiments of the invention are shown. The invention may, however, be embodied in different forms and should not be limited to the embodiments set forth. Like numbers refer to like elements.

An embodiment according to the present invention is depicted in FIG. 1. In the present invention, the crescent former contains two sections: a forming section 11 and a drying section in the vicinity of Yankee cylinder 7 and roll 3' as discussed in more detail below. A separate conventional pressing section is not required due to the arrangement of the forming section 11 of the present invention.

The forming section 11 of the present crescent former differs from that of conventional formers in that the forming roll 2 and a press roll 3 form a press nip 10. The press roll 3 stands in place where a guide roll is typically provided in a forming section 11 of a conventional system (although it serves the purpose of a guide roll in the configuration of FIG. 1 as well). The press roll 3 of the present invention can have a soft or hard cover/belt and can be a shoe roll or extended nip roll, attributes which differ from the conventional guide roll of the conventional forming section 11. Ideally, these components help to provide at least one substantially uniform pressure plateau across the width of the nip. A nip with uniform plateau over its width provides even distribution and pressure along the paper sheet resulting in consistent smoothness throughout. To produce the desired water/solid content of the paper sheet, the nip is set to have a force between 10 to 200 N/mm, 60 to 120 N/mm or between 90 to 110 N/mm. Prior to entering through the press nip 10, the solid content of the paper sheet can be between 4% to 40%, but tends to be in the range between 4% to 14% or 9% to 12%. After the paper sheet has passed through the press nip 10, the solid content of the paper sheet may be between 9% to 48%, but most likely between 30% to 48% or 40% to 46%. The pressure set at the press nip 10 determines the solid content. The pressure is controlled by the position of the press roll 3 and/or the component therein forming the nip 10.

The introduction of the press roll 3 eliminates the need for a separate pressing section. However, the forming section 11 of the present invention does not simply differ in the replacement of a guide roll with a press roll, a number of modifications to a conventional forming section 11 must be made to integrate the pressing roll as explained below.

In the forming section 11, paper pulp usually in a pulp slurry is firstly sprayed by a headbox 1 into a gap section defined by the area around the initial contact point of a wire 5 and a felt 6 (where the two are brought together at the forming roll 2) and the headbox 1 itself. The wire 5 is used to create a sandwiching with the felt 6 of the paper pulp, while the felt 6 additionally continues to act as the carrier of the paper sheet throughout the system following the forming section 11. This sandwich is maintained throughout the forming section 11, the sandwich wrapping around the forming roll 2. In this application, the bottom side of the sheet is considered the face of the sheet contacting the felt 6, and the top side of the paper sheet is considered the face contacting the wire 5.

The headbox 1 includes a jet, which applies the pulp in a stream. In the present invention, the jet may impact the wire 5, the felt 6 or both the wire 5 and felt 6. This geometry depends on a variety of factors, the headbox apron position and the breast roll 12 vs forming roll 2 position, as well as on the headbox 1 tilting. The jet impact point/area onto the wedge formed by the wire 5 and the felt 6 along with its main stream direction is referred to as the jet impingement 13 in the present application.

Following the jet impingement 13, the sandwiched wire 5, paper sheet and felt 6, are brought into the forming zone of the forming section 11 by the forming roll 2. The forming zone area is a portion of the forming roll 2 surface and can be setup to cover a wide range of angles, for example between 10° and 180°, between 30° and 120° and between 30° and 75° with respect to a jet impingement 13 onto the forming roll 2. The forming zone is used to remove excess water of the paper sheet via the movement speed caused by rotational force of the forming roll 2.

The centrifugal force of the forming roll 2 in combination with the sandwich configuration of the wire 5 and felt 6 causes water to be forced out of the paper sheet through the wire 5. To prevent this water from freely contacting other components of the system, a save-all 9 is included in the forming section 11 to collect this free water, conventionally known as white water. While FIG. 1 shows a single save-all component 9, it should be noted that it may take the form of a plurality of components as well.

The paper sheet thereafter travels through the press nip 10 formed by the forming roll 2 and the press roll 3. Due to the replacement of a conventional guide roll with the press roll 3 against the forming roll 2, the forming roll 2 must be modified to maintain proper functioning. Specifically, a suction zone 8 is essential in the forming roll 2 in the area around the press nip 10. After the forming zone 11 the press nip 10 removes a large amount of water squeezed out of the paper sheet at this point and rewetting of the sheet between the felt 6 and the wire 5 must be prevented. A suction zone 8 set up in the forming roll 2 around the nip helps to solve this problem, pulling excess water in and consequently draining it.

In FIG. 1, there is shown one angle $\alpha$ representing a suction zone 8 in the area of the press nip 10. The present invention is not limited in this manner, as additional suction zones are also beneficial, for example as well immediately before and/or after the press nip 10. These suction zones are defined with an arc a with respect to a jet impingement 13 onto the forming roll 2 and the angle may range between 5° and 180°, between 5° and 75° and between 15° and 45°. Additionally a forming angle $\beta$ is shown.

To help manage the pressed-out water at the press-nip, the forming roll 2 can have perforations and grooves about the surface of the roll. If the roll would be entirely smooth, the water and air would have no room to escape the press, staying in the felt 6 and paper sheet. This can ruin the paper sheet, creating bubbles or worse, piercing the paper sheet. Perforations will allow the air (and also some water) to enter into the suction element of the forming roll 2 itself, while grooves provide space for the water to reside and can be collected by a save-all after the paper sheet is transferred away from the forming roll 2.

Additionally, since the methods for collecting water in the forming zone 11 and suction zone 8 differ, they collect water on opposite sides (away from the forming roll 2, and into the forming roll 2, respectively), it is also desirable in the present invention to avoid an overlap of these two types of zones (that the suction zone 8 does not cover at all part of the forming zone area). Furthermore, the suction zone works best on a formed paper sheet contributing to its preferred position following the forming zone. However, the present invention is flexible also to allow these zones to overlap slightly in one section. The range of this overlap may be between 5° and 90°, 10° and 75° and preferably a smaller range such as between 15° and 25°.

An additional save-all 4 is also shown in the embodiment of FIG. 1, following the suction zone. The forming roll 2 will be wet from the press nip 10 even after the felt 6 carries the paper sheet away from the forming section 11. Therefore, to prevent the water from re-entering the system as it returns to a position to carry the felt 6 and paper pulp at the jet impingement 13, the second save-all 4 collects residual white water that is sprayed from for example, the surface of the forming roll 2. The water from both save-alls 4, 9 is drained and re-used or appropriately disposed from the process which is not in the focus of the present application.

The paper sheet travels from the forming section 11 directly to the drying section. In this section, the top side of the paper sheet is free (as the wire 5 has been guided away from the paper sheet and felt 6) and the bottom side contacts, and is carried by, the felt 6. Since there is no separate pressing section in the present invention, the distance between these sections is reduced. This in turn reduces the chance of errors occurring in this travelling time, such as the paper sheet being shifted or loosened from the felt 6.

The drying section of the present invention includes a dryer and a counter/guide roll which preferably is a second press roll. The dryer is preferably a Yankee cylinder 7. The felt 6 carries the paper sheet through a nip created between the Yankee cylinder 7 and the counter/guide roll 3'. The counter/guide roll 3' is positioned such that the paper sheet is transferred on to the Yankee cylinder 7 after the nip. The paper sheet is thereafter dried in the Yankee cylinder 7 and processed to produce the desired paper. The drying section is set according to conventional standards and is not explained in further detail for brevity of the present description.

Figure 2:
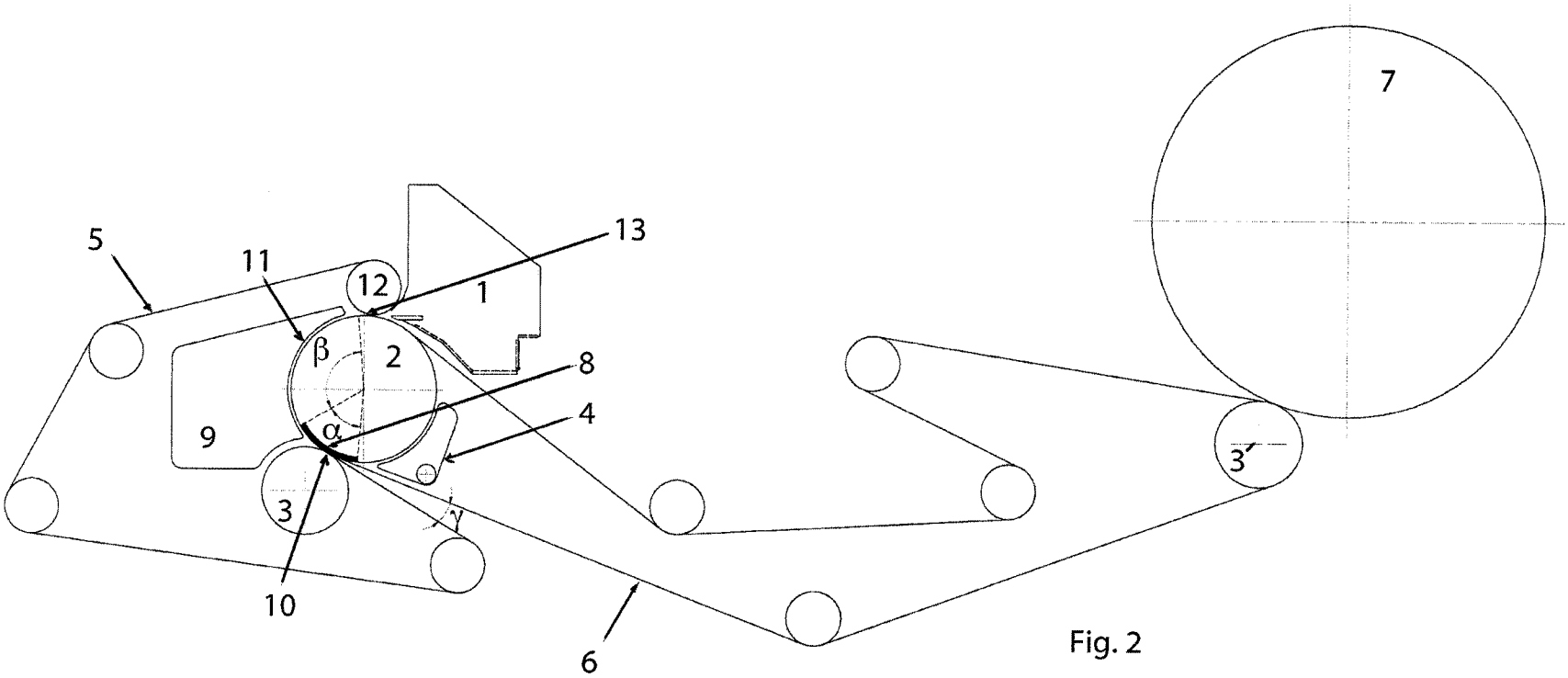
FIG. 2 is a schematic diagram of the system according to a second configuration of the present invention.

FIG. 2 depicts another embodiment according to the present invention. Like numerals refer to like components. In this alternative embodiment, an adjustable guide roll is provided downstream of the press roll 3 of the forming section 11. The adjustable guide roll is utilized to change the angle $\gamma$ of the wire 5 separating from the sandwiched paper sheet and felt 6. A lower position for the adjustable guide roll will provide a greater angle of separation and faster separation of the wire 5 from the sandwich, while a higher position for the adjustable guide roll provides a more gradual change and smaller separation angle $\gamma$.

The present invention as described above is most appropriate for formers and specifically crescent formers for producing tissue paper, such as hygienic tissue papers, facial tissues, paper towels, wrapping tissues, toilet tissues, table napkins and the like, but not limited thereto. As can be understood from the two configurations described above, the present paper machine thus allows a paper sheet to pass through a press nip 10 and being formed in the forming section 11, rather than in a separate pressing section.

From the foregoing, it can be seen that the present invention is a system, which can produce tissue paper over a wide variety of tissue grades and moisture levels via the two configurations described above and exemplified in FIGS. 1 and 2. Moreover, it is a simple task to convert the system from the first to the second configuration.

Additionally, by the inventor's realization in which the guide roll is contacting against the forming roll 2 and can also serve as the pressing roll, the paper machine of the present invention reduces the number of necessary components and space required. This leads to monetary reduction as well as reduction of energy costs for installation and maintenance, as fewer components are required in the paper machine. The more compact nature of the paper machine allows it to be installed in a wider variety of places and allows the saved space to be utilized for other purposes. In the course of installing multiple machines, this effect is amplified accordingly.

Although specific features of the present invention are shown in some drawings and not in others, this is for convenience only, as each feature may be combined with any or all of the other features in accordance with the invention. While there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps that perform substantially the same function, in substantially the same way, to achieve the same results be within the scope of the invention. Substitutions of elements from one described embodiment to another are also fully intended and contemplated. It is also to be understood that the drawings are not necessarily drawn to scale, but that they are merely conceptual in nature.

It is the intention, therefore, to be limited only as indicated by the scope of the claims appended hereto. Other embodiments will occur to those skilled in the art and are within the following claims.

What is claimed is:

1. A former section capable of producing paper, comprising:

a headbox, a felt, a wire, a forming roll having a suction zone, a save-all for collecting water from a forming section in the area of the forming roll;

a gap section defined by the section between the headbox and a position where the felt and the wire are brought together at the forming roll;

wherein the headbox distributes a pulp slurry into the gap section to be sandwiched by the felt and the wire to form a paper sheet and wherein (1) a bottom side of the paper sheet contacting the felt, (2) a top side of the paper sheet contacting the wire, and (3) the sandwiched felt, paper sheet and wire wrapping around the forming roll; and a press roll which forms a press nip with the forming roll through which the paper sheet is carried by the felt and the wire, and the suction zone of the forming roll being arranged in a section surrounding the paper sheet and around the nip, wherein the press roll is one of a shoe roll and an extended nip roll which forms the press nip.

2. The former section of claim 1 wherein the suction zone includes a section positioned at least one of before the press nip, along the press nip and after the press nip.

3. The former section of claim 1 wherein the forming roll comprises at least one forming zone which is a part of the forming roll surface having an angle between 10° and 180° starting from a jet impingement point onto the forming roll.

4. The former section of claim 3 wherein the suction zone does not cover or overlap the forming zone.

5. The former section according to claim 3, wherein the suction zone does at least overlap the forming zone area in one section in a range between 5° to 90°.

6. The former section of claim 1 wherein the suction zone is formed with an arc between 5° and 180° starting from a jet impingement point onto the forming roll.

7. The former section of claim 1 wherein the press roll provides at least one substantially uniform pressure plateau across the width of the press nip.

8. The former section of claim 1 wherein the press roll forms the press nip to have a force between 10 to 200 N/mm.

9. The former section of claim 1 wherein (1) the solid content of the paper sheet before the press nip at the forming roll is between 4% to 15% and (2) the solid content of the paper sheet after the press nip at the forming roll is between 9% to 48%.

10. The former section of claim 1 wherein the forming roll has perforations and grooves along the surface.

11. The former section of claim 1 further including at least a second save-all at the end of the suction zone.

12. The former section of claim 1 wherein the press roll guides the wire.

13. The former section of claim 1 further including an adjustable guide roll positioned downstream of the press roll.

14. The former section of claim 1 wherein the former section is a crescent former for producing tissue paper grades.

15. The former section of claim 1 wherein the former section is included in a machine that manufactures at least one of paper, board and tissue paper.

16. A combination of a former section capable of producing paper with a yankee cylinder, the combination comprising:

a headbox, a felt, a wire, a forming roll having a suction zone, a save-all for collecting water from a forming section in the area of the forming roll;

a gap section defined by the section between the headbox and a position where the felt and the wire are brought together at the forming roll;

wherein the headbox distributes a pulp slurry into the gap section to be sandwiched by the felt and the wire to form a paper sheet and wherein a bottom side of the paper sheet contacting the felt and a top side of the paper sheet contacting the wire, the sandwiched felt, paper sheet and wire wrapping around the forming roll; and a press roll which forms a press nip with the forming roll through which the paper sheet is carried by the felt and the wire, and the suction zone of the forming roll being arranged in a section surrounding the paper sheet and around the press nip, wherein the press roll is one of a shoe roll and an extended nip roll; and a yankee cylinder and a second press roll which form a second nip with the yankee cylinder wherein the paper sheet is transferred directly to the yankee cylinder by the felt carrying the paper sheet through the second nip and is finally dried at the yankee cylinder to a final paper state.

17. A combination of a former section with a press section, the combination capable of producing paper, comprising:

a headbox, a felt, a wire, a forming roll having a suction zone, a save-all for collecting water from a forming section in the area of the forming roll;

a gap section defined by the section between the headbox and a position where the felt and the wire are brought together at the forming roll;

wherein the headbox distributes a pulp slurry into the gap section to be sandwiched by the felt and the wire to form a paper sheet and wherein a bottom side of the paper sheet contacting the felt and a top side of the paper sheet contacting the wire, the sandwiched felt, paper sheet and wire wrapping around the forming roll; and a press roll which forms a press nip with the forming roll through which the paper sheet is carried by the felt and the wire, and the suction zone of the forming roll being arranged in a section at least including the press nip, wherein the press roll is one of a shoe roll and an extended nip roll.

* * * * *